US007516631B2

(12) United States Patent
Hacker et al.

(10) Patent No.: US 7,516,631 B2
(45) Date of Patent: Apr. 14, 2009

(54) SAFE WITH LOCKING CARTRIDGE DOOR

(75) Inventors: Dean D. Hacker, Oak Creek, WI (US); Steven Hedlund, Racine, WI (US); Zachery Nave, Oak Creek, WI (US); John Weber, Thienville, WI (US)

(73) Assignee: Master Lock Company LLC, Oak Creek, WI (US)

( * ) Notice: Subject to any disclaimer, the term of this patent is extended or adjusted under 35 U.S.C. 154(b) by 121 days.

(21) Appl. No.: 11/711,433

(22) Filed: Feb. 27, 2007

(65) Prior Publication Data

US 2008/0127866 A1 Jun. 5, 2008

Related U.S. Application Data

(60) Provisional application No. 60/872,327, filed on Dec. 1, 2006.

(51) Int. Cl.
*B65D 55/14* (2006.01)

(52) U.S. Cl. ..... 70/63; 704/451; 704/312; 109/51; 109/52; 109/59 R

(58) Field of Classification Search ..... 70/63, 70/451, 312, 333 A; 109/23, 50–52, 59 R
See application file for complete search history.

(56) References Cited

U.S. PATENT DOCUMENTS 1,634,884 A * 7/1927 Peer ..... 109/51
3,026,704 A * 3/1962 Baker ..... 70/451
3,146,739 A * 9/1964 Furman ..... 109/52
3,742,741 A * 7/1973 Cahan ..... 70/63
3,934,434 A * 1/1976 Law ..... 70/63
4,641,505 A * 2/1987 Maurice ..... 70/63
4,651,544 A * 3/1987 Hungerford ..... 70/63
4,838,052 A * 6/1989 Williams et al. ..... 70/63
4,951,577 A * 8/1990 Bentley ..... 109/51
5,737,947 A * 4/1998 Ling ..... 70/63
5,738,020 A * 4/1998 Correia ..... 109/51
5,758,522 A * 6/1998 York ..... 70/63
5,927,114 A * 7/1999 Berry ..... 70/332

(Continued)

OTHER PUBLICATIONS

International Search Report and Written Opinion from International Application No. PCT/US2007/04968, mailed Aug. 27, 2008.

*Primary Examiner*—Suzanne D Barrett
(74) *Attorney, Agent, or Firm*—Calfee, Halter & Griswold LLP

(57) ABSTRACT

A safe includes a housing, a door and a locking mechanism. The housing includes a lock interface disposed on an external surface of the housing. The housing defines an internal cavity in communication with an opening of the housing. The door is configured to be assembled with the opening of the housing. The door includes first and second shackle legs configured to extend into the housing when the door is assembled with the housing. The locking mechanism is disposed within the housing and includes at least one locking member configured to lockingly engage the first and second shackle legs when the door is assembled with the housing. When the door is assembled with the housing, proper manipulation of the lock interface disengages the at least one locking member from the first and second shackle legs, thereby allowing the door to be removed from the housing.

19 Claims, 10 Drawing Sheets

U.S. PATENT DOCUMENTS

| | | | | |
|---|---|---|---|---|
| 6,813,912 | B1 * | 11/2004 | Ng et al. | 70/21 |
| 6,834,519 | B1 * | 12/2004 | Yang | 70/58 |
| 7,057,660 | B1 * | 6/2006 | Okuda | 348/373 |
| 7,251,967 | B2 * | 8/2007 | Yang | 70/63 |
| 7,299,667 | B1 * | 11/2007 | Miresmaili | 70/58 |
| 2004/0226325 | A1 * | 11/2004 | Ling | 70/63 |
| 2005/0223758 | A1 * | 10/2005 | Yu | 70/63 |
| 2006/0065024 | A1 * | 3/2006 | Gutierrez et al. | |
| 2006/0213237 | A1 * | 9/2006 | Yang | 70/63 |
| 2007/0180873 | A1 * | 8/2007 | Yen et al. | 70/63 |
| 2008/0098939 | A1 * | 5/2008 | Kalous et al. | 109/52 |
| 2008/0115544 | A1 * | 5/2008 | Yang | 70/63 |

* cited by examiner

SAFE WITH LOCKING CARTRIDGE DOOR

CROSS REFERENCE TO RELATED APPLICATION

This application claims the benefit of U.S. Patent Application Ser. No. 60/872,327, entitled "SAFE WITH LOCKING CARTRIDGE DOOR" and filed Dec. 1, 2006, the entire contents of which are incorporated herein by reference, to the extent that they are not conflicting with the present application.

FIELD OF THE INVENTION

The present invention relates to safes and to safes having locking doors that when disengaged from locking members are movable to access items stored within the safe.

BACKGROUND OF THE INVENTION

Safes are used in many indoor and outdoor environments to restrict access to various items by providing an enclosure with a door or other such access port. A safe includes a locking mechanism, such as, for example, a combination lock, padlock, or key operated latch, to limit access to the contents of the safe to one or more authorized users. Some applications may require secure storage of a smaller item, such as, for example, a key. One example of such a situation involves a key used to gain access to a location or structure to which many individuals may from time to time require access, such as, for example, a storage locker, office building, or a portion of a vehicle or structure attached to a vehicle, such as, for example, a trunk, trailer, or car top/cargo carrier. Where multiple users require access to such a key, it may be desirable to store the key on or near the location or structure with which the key is used. While keeping the key in an unsecured location would risk loss or theft of the key, thereby compromising the lock with which the key is associated, conventional safes and other locking enclosures may be impractical or ineffective for securely storing the key. A larger locked enclosure, such as a more traditional safe, may be aesthetically undesirable, inconvenient, or obstructive, and may not be easily mountable, for example, to a wall or door. A smaller portable safe, if kept in a location where any potential authorized user may access it, may be at risk of loss or theft of the entire safe, along with its contents.

SUMMARY

As described in the present application, a safe may be configured such that a door is movable upon proper manipulation of a lock interface. In one such embodiment, a safe includes a housing, a door and a locking mechanism. The housing includes a lock interface disposed on an external surface of the housing. The housing defines an internal cavity in communication with an opening of the housing. The door is configured to be assembled with the opening of the housing. The door includes first and second shackle legs configured to extend into the housing when the door is assembled with the housing. The locking mechanism is disposed within the housing and includes at least one locking member configured to lockingly engage the first and second shackle legs when the door is assembled with the housing. When the door is assembled with the housing, proper manipulation of the lock interface disengages the at least one locking member from the first and second shackle legs, thereby allowing the door to be removed from the housing.

According to another inventive feature described in the present application, a mounting arrangement may be provided, for example, for mounting a safe to a structure, wherein access to the mounting arrangement is restricted when the mounted safe is in a locked condition to prevent removal of the locked safe from the structure. In one such embodiment, a mounting plate for affixing to the structure engages a retaining bracket for mounting to the safe, and the retaining bracket may only be disengaged from the mounting plate when the safe is in an open condition.

According to still another inventive feature described in the present application, a safe may be provided with an illuminating mechanism configured to illuminate a light source when a user intends to manipulate a lock interface to unlock the safe. In one such embodiment, a safe includes a cover member movable to cover a lock interface in a covering position and movable to expose the lock interface in an uncovered position, and an illuminating mechanism is configured to illuminate a light source when the cover member is moved to the uncovered position.

BRIEF DESCRIPTION OF THE DRAWINGS

Features and advantages of the invention will become apparent from the following detailed description made with reference to the accompanying drawings, wherein.

DETAILED DESCRIPTION OF THE INVENTION

Figure 1A:
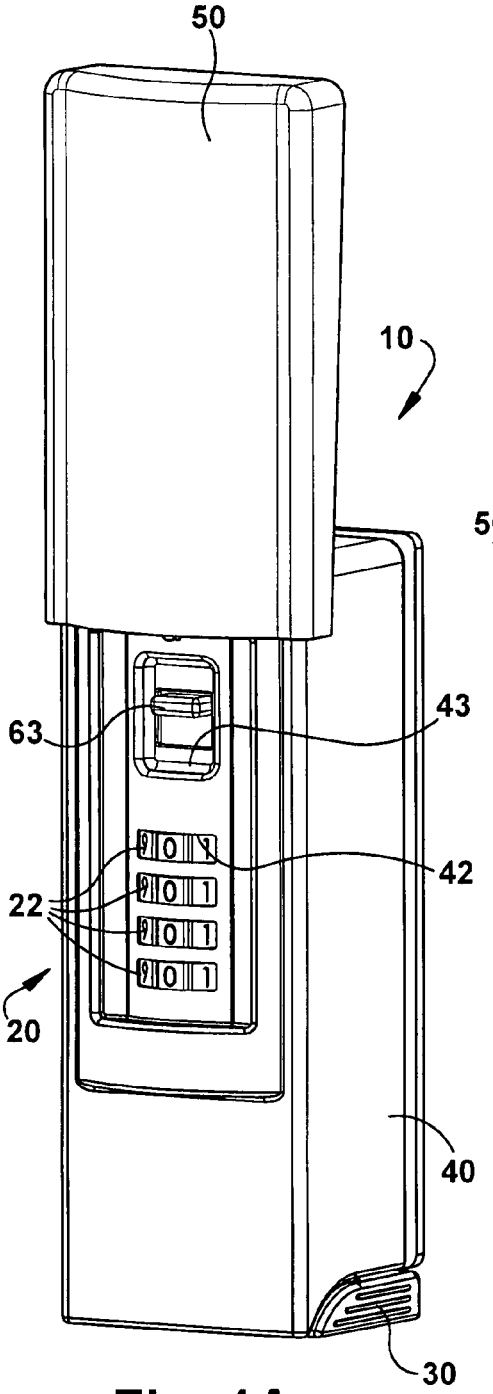
FIG. 1A illustrates a front perspective view of a safe with combination dials exposed.

This Detailed Description of the Invention merely describes embodiments of the invention and is not intended to limit the scope of the claims in any way. Indeed, the invention as described is broader than and unlimited by the embodiments described herein, and the terms used have their full ordinary meaning.

According to an inventive aspect of the present application, a safe may be provided for mounting to a structure, such as, for example, a building or a vehicle. An exemplary safe includes a housing, a lockable door, and a locking mechanism having a locking interface for moving the lockable door between a locked condition and an unlocked condition. In one embodiment, the door may include one or more shackle legs, of many different possible shapes, sizes or cross-sections (not to be limited to traditional padlock shackle legs), each being securable within the safe by a corresponding locking member, such as, for example, a roller or ball bearing, configured to move in and out of engagement with a portion of the shackle leg, such as, for example, a notch, hole, or recess. In the door's unlocked condition, the locking members are disengaged from the corresponding shackle legs, and the door is movable to provide access to an internal portion of the safe. In one embodiment, the door is removable to provide access to the internal portion of the safe. The door may, but need not, be provided with a slot, pocket, or other such recess to receive at least a portion of an item stored within the safe, such that when the door is unlocked and removed, the stored item is also removed from the safe.

Many different locking interfaces may be provided with a safe, such as, for example, a key operated lock, an electronic key entry (push button) lock, a remote control operated (e.g., infrared or radio waves) lock, or a combination lock utilizing single or multiple combination dials. In one embodiment, a locking interface is configured such that proper manipulation of the interface causes one or more locking members to disengage from corresponding shackle legs to allow the door to be moved to an open (either removed or attached) position.

In the illustrated embodiment, as shown in FIGS. 1A-3, an exemplary safe 10 includes a locking interface 20 having four combination dials 22 extending through slots 42 in the housing 40 to be accessible by the user. When the four dials 22 are rotated to a predetermined authorized combination, the cartridge door 30 is movable from the locked to the unlocked condition, and the door 30 may be removed from the safe housing 40 to access an internal portion of the safe 10. While the illustrated dials are shown with ten increments labeled "0" through "9," the dials may be provided with a different number of increments and with different labeling (e.g., letters or symbols). The safe 10 may also include a spring plate 29 (see FIG. 2) in engagement with the dials 22, to more tightly control incremental movement of each of the dials 22 and provide a tactile indication to the user of proper placement of the dials 22. Additionally, a dial cover 50 may be provided to cover the dials 22 when the safe 10 is not in use.

Figure 2:
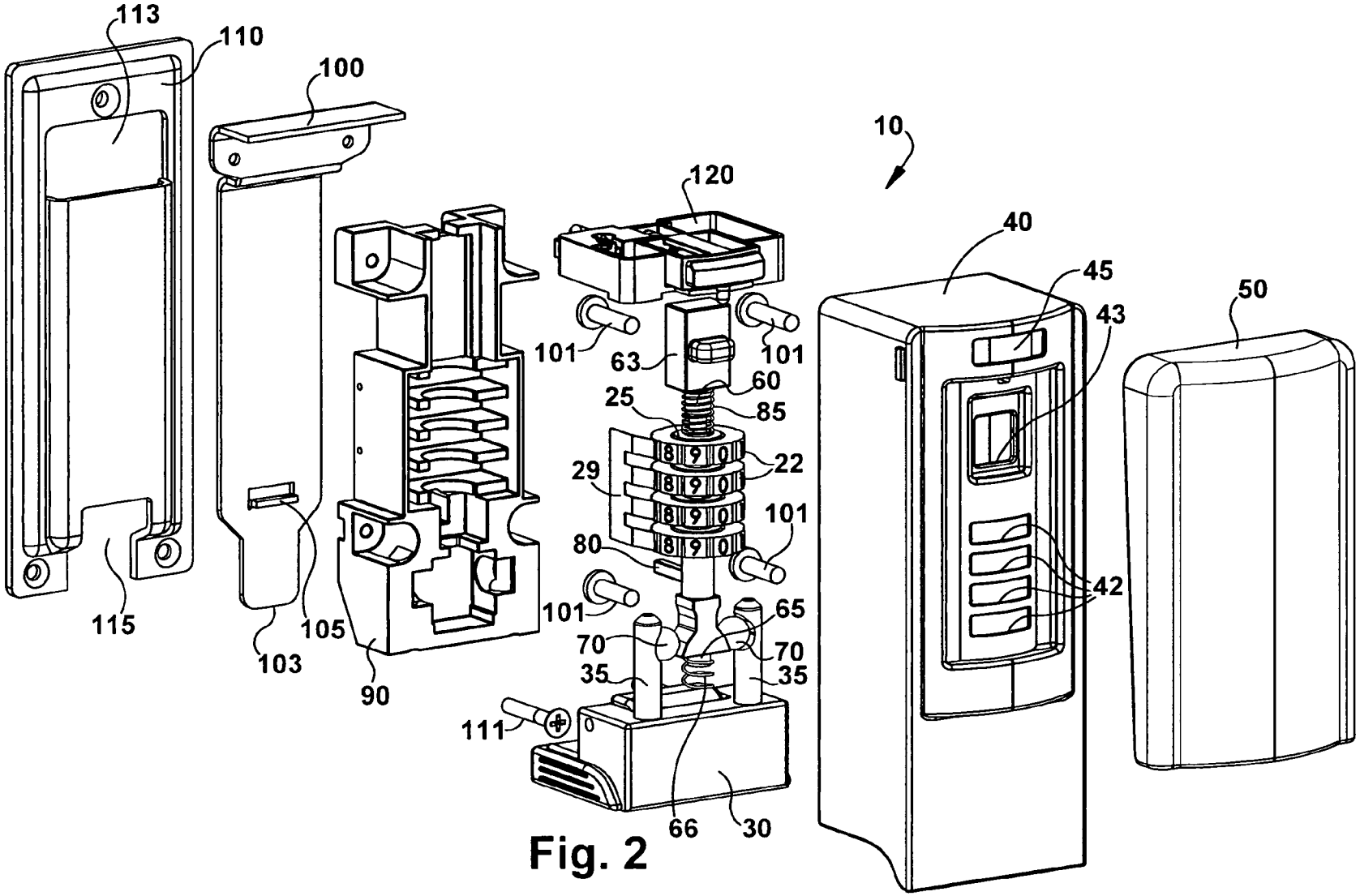
FIG. 2 illustrates an exploded perspective view of the safe of FIG. 1A.
Figure 2A:
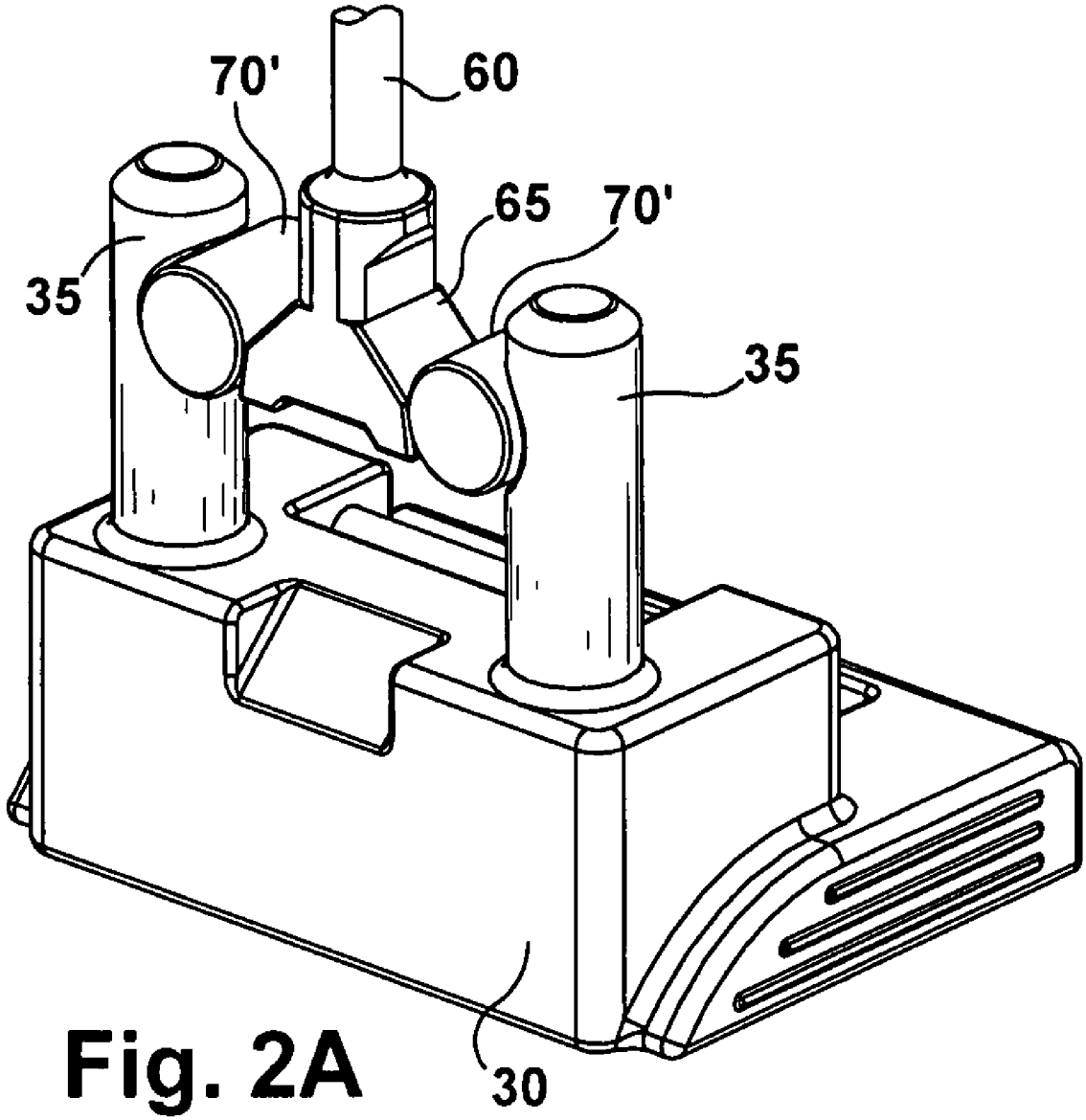
FIG. 2A illustrates a partial perspective view of a safe door locking mechanism.
Figure 3:
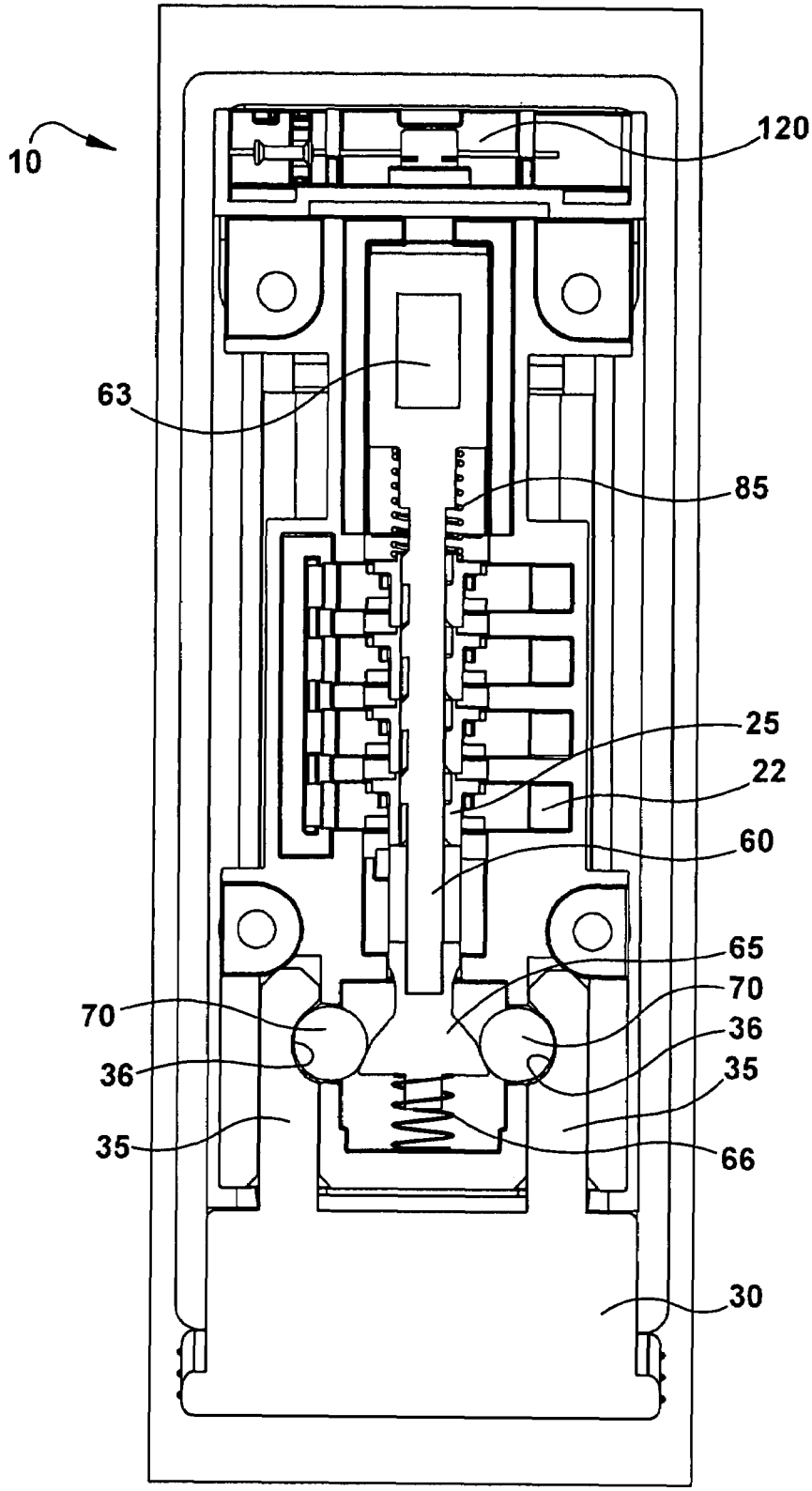
FIG. 3 illustrates a rear cross-sectional view of the safe of FIG. 1A.
Figure 4:
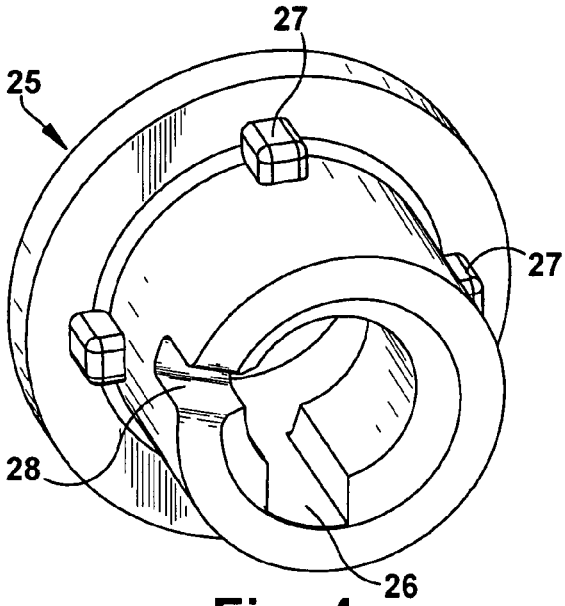
FIG. 4 illustrates a perspective view of a hub of the safe of FIG. 1A.

Many different mechanisms may be provided to enable movement of the door 30 from the locked to the unlocked condition upon rotation of the dials 22 to the authorized combination, including, for example, a spring-loaded latch or a slide lever connected with the safe door. In the illustrated embodiment, as best seen in FIGS. 3 and 4, the exemplary safe 10 includes a release post 60 which includes a wedge extension 65 (which may be assembled to or integral with the post 60) having a wider portion that aligns with locking members 70 to force the locking members 70 into engagement with shackle legs 35 when the safe 10 is in a locked condition. While the illustrated locking members 70 comprise locking balls or ball bearings, many different types and shapes of locking members may be used, including, for example, cylindrical shaped rollers 70', as shown in FIG. 2A. When the dials 22 are rotated to an authorized combination, the post 60 is allowed to move axially with respect to the dials 22, to a release position, in which a narrower portion of the wedge extension 65 aligns with the locking members 70 to allow the locking members to disengage from the shackle legs 35. Recesses 36 in the shackle legs 35 (see FIG. 3) that receive the locking members 70 may be contoured such that when the user pulls on the door 30, the shackle leg recesses 36 force the locking members 70 inward and out of engagement with the shack legs 35. While the post 60 may be spring-loaded to automatically move to a release position upon rotating the dials 22 to the authorized combination, the safe 10 may be provided with a manual user-accessible release lever or button, directly or indirectly connected with the post, which may be operated to move the post 60 to the release position. In the illustrated embodiment, a release button 63 integral with the post 60 extends through an opening in the housing cover 20. When the dials 22 are rotated to an authorized combination, the release button 63 may be pressed downward to direct the post 60 downward, disengaging the locking members 70 from the shackle legs 35. A spring 66 may be assembled with the wedge extension 65 to bias the post 60 and wedge extension 65 back to a locking position. The illustrated safe 10 further includes a housing frame 90, assembled with the housing 40, for example, with fasteners 101. The housing frame 90 supports the locking members 70, dials 22, and other internal components of the safe 10. The housing 40, housing frame 90, and door 30 may together define a cavity 99 (see FIG. 12) in which an item, such as, for example, a key, may be securely stored.

Figure 6:
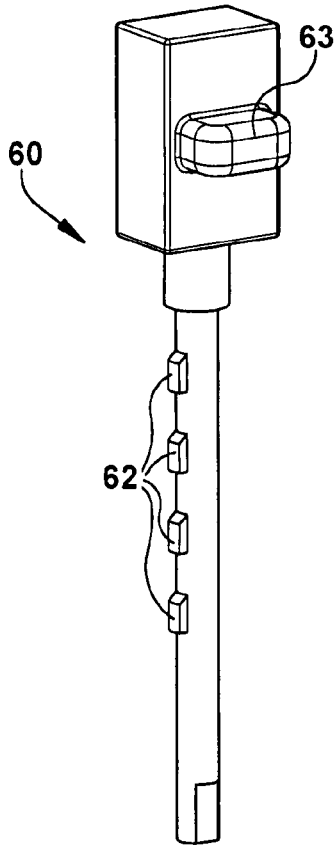
FIG. 6 illustrates a perspective view of a locking post of the safe of FIG. 1A.
Figure 5:
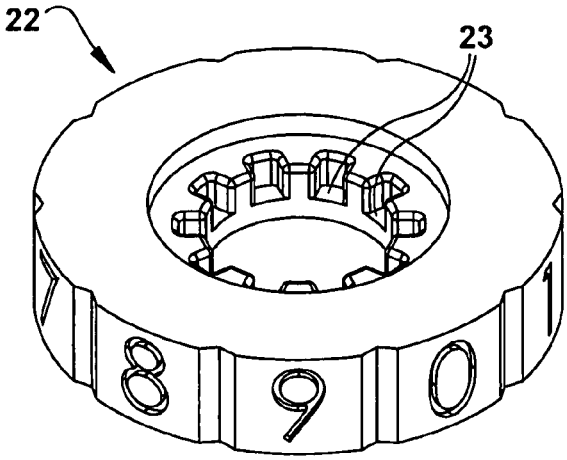
FIG. 5 illustrates a perspective view of a combination dial of the safe of FIG. 1A.

Many different configurations may be used to secure the post 60 in a locked position when the dials 22 are not positioned in the authorized combination, and to allow the post 60 to be moved to the release position when the authorized combination is dialed. In one embodiment, the post 60 may be provided with a series of projections, each blocking axial movement of the post 60 with respect to the dials 22. When each dial is rotated to a proper position, a groove associated with each dial 22 is aligned with a corresponding projection, such that rotation of all the dials to their predetermined proper positions allows the post 60 to be axially moved, such that the projections slide through the corresponding grooves. In one embodiment, a groove may be integrally formed in each dial. In the illustrated embodiment, the dials 22 connect with, and rotate with, corresponding hubs 25 (shown more clearly in FIG. 4). Each hub includes one or more nubs 27 which are received in corresponding notches 23 (see FIG. 5) of a corresponding dial 22, such that the hub 25 rotates with the corresponding dial 22 when manipulated by the user. Each hub 25 also includes an internal groove 26 sized to allow a corresponding rib or projection 62 (see FIG. 6) on the post 60 to pass through the groove 26 when the projection 62 and groove 26 are aligned. Each hub 25 may also include a visual indicator on an outer surface of the hub 25 in a fixed position with respect to the groove 26, to facilitate alignment of the grooves 26 with the projections 62 of the post 60 during assembly of the safe 10. In the illustrated embodiment, as shown in FIG. 4, the visual indicator includes a notch 28 in a lower surface of the hub 25; however, the visual indicator may alternatively or additionally include markings, projections, or other such identifiers.

Figure 7:
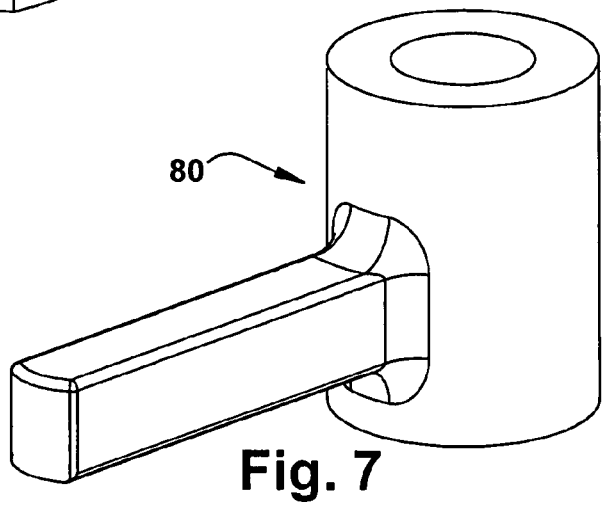
FIG. 7 illustrates a perspective view of a reset lever of the safe of FIG. 1A.
Figure 8:
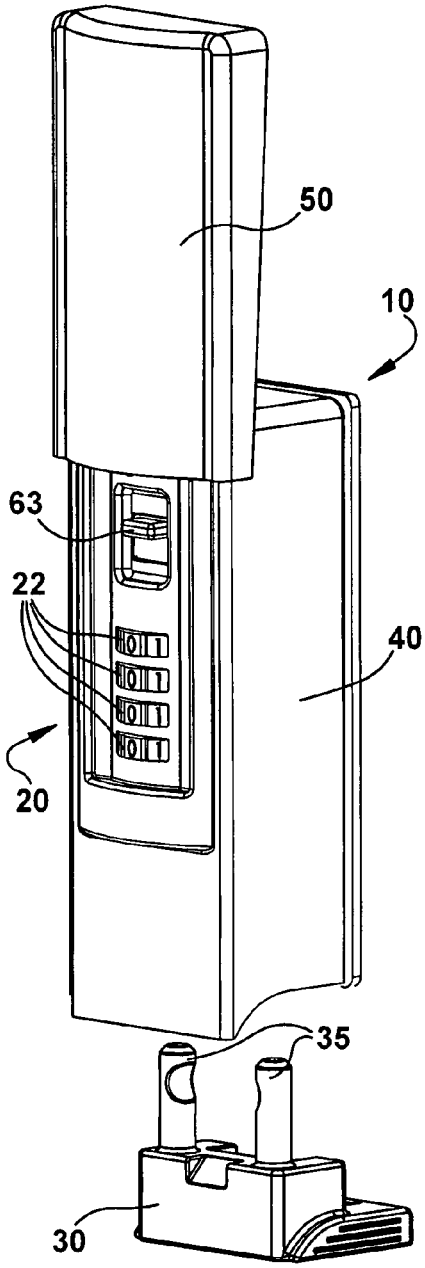
FIG. 8 illustrates a perspective view of the safe of FIG. 1A, with the cartridge door removed.
Figure 9:
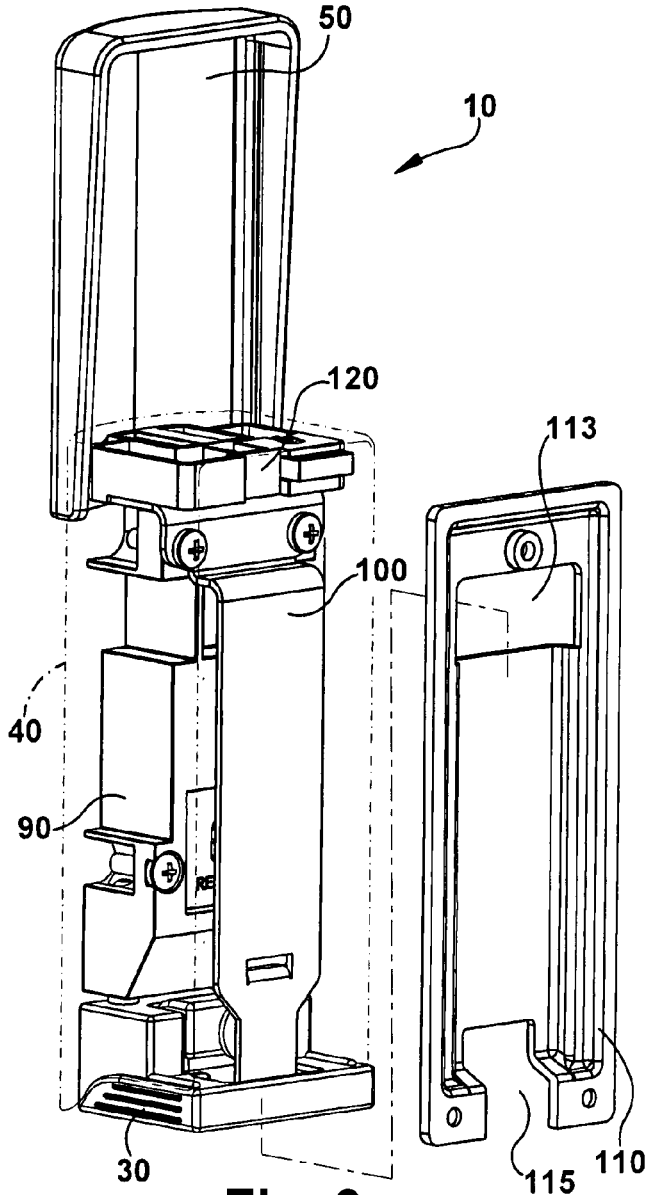
FIG. 9 illustrates a rear perspective view of the safe of FIG. 1A, disassembled from a mounting plate with housing cover shown in phantom to illustrate additional features of the safe.
Figure 10:
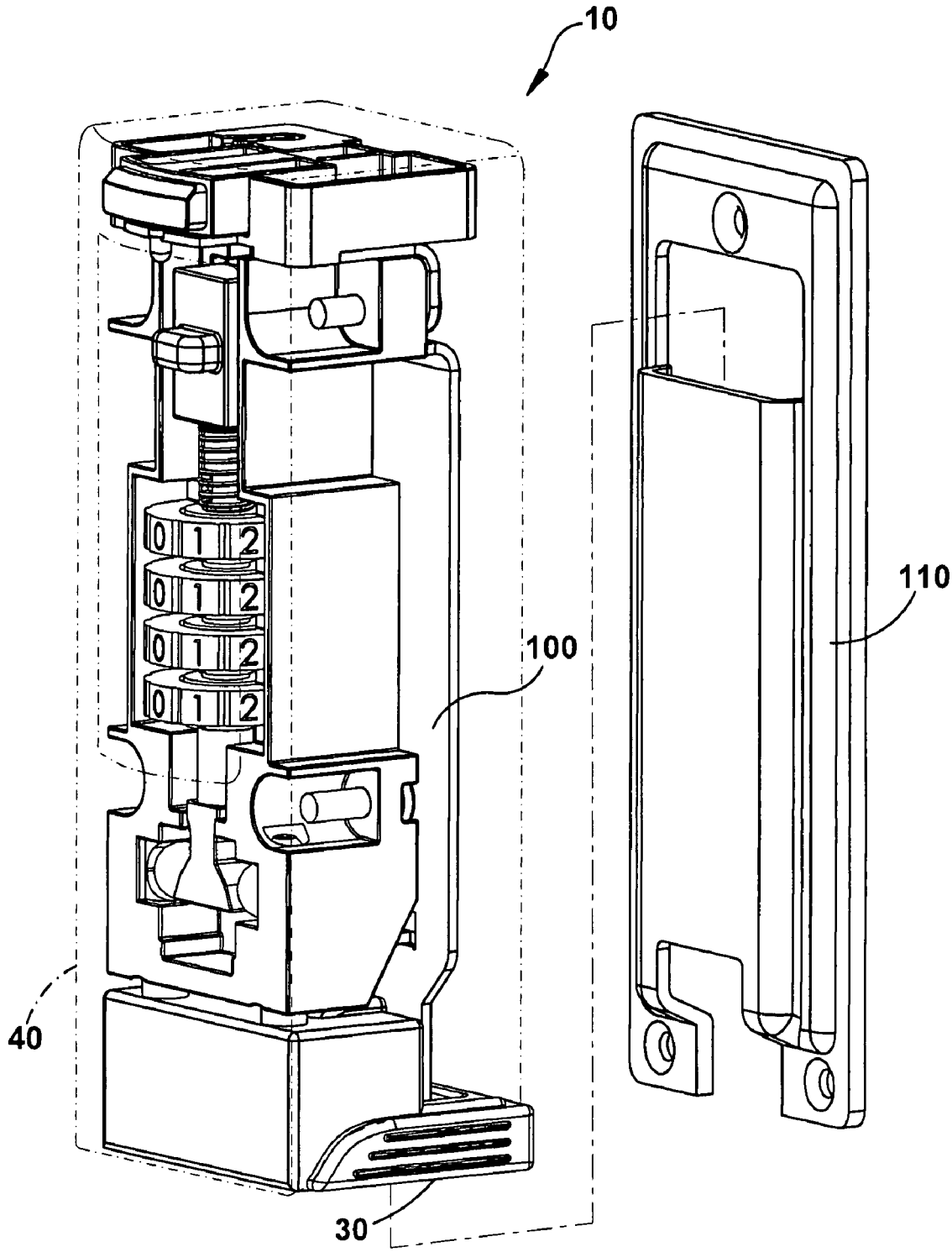
FIG. 10 illustrates a side perspective view of the safe of FIG. 1A, disassembled from the mounting plate with housing cover and cartridge door shown in phantom to illustrate additional features of the safe.
Figure 11:
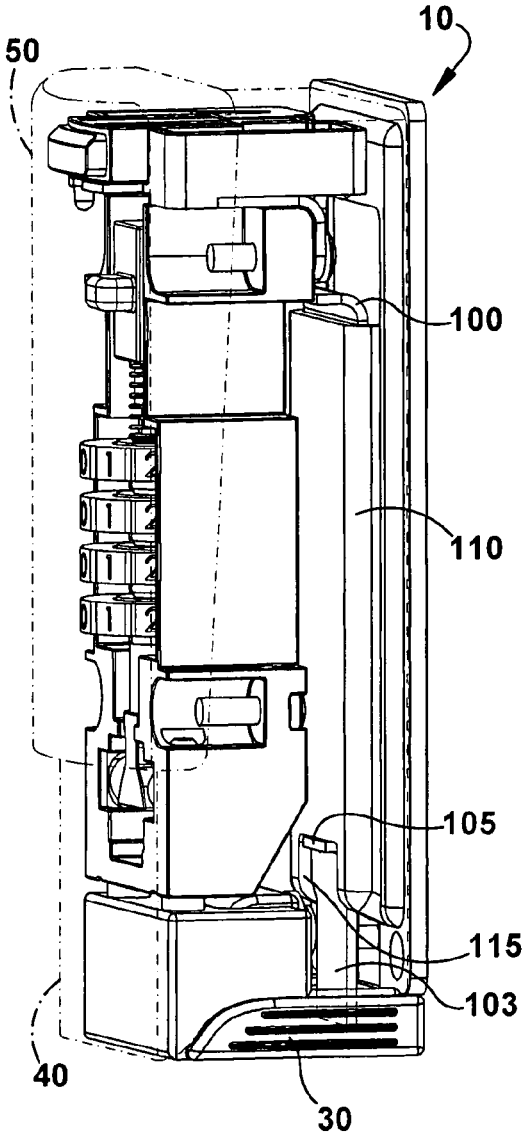
FIG. 11 illustrates a side perspective view of the safe of FIG. 1A, assembled with the mounting plate with housing cover and cartridge door shown in phantom to illustrate additional features of the safe.
Figure 12:
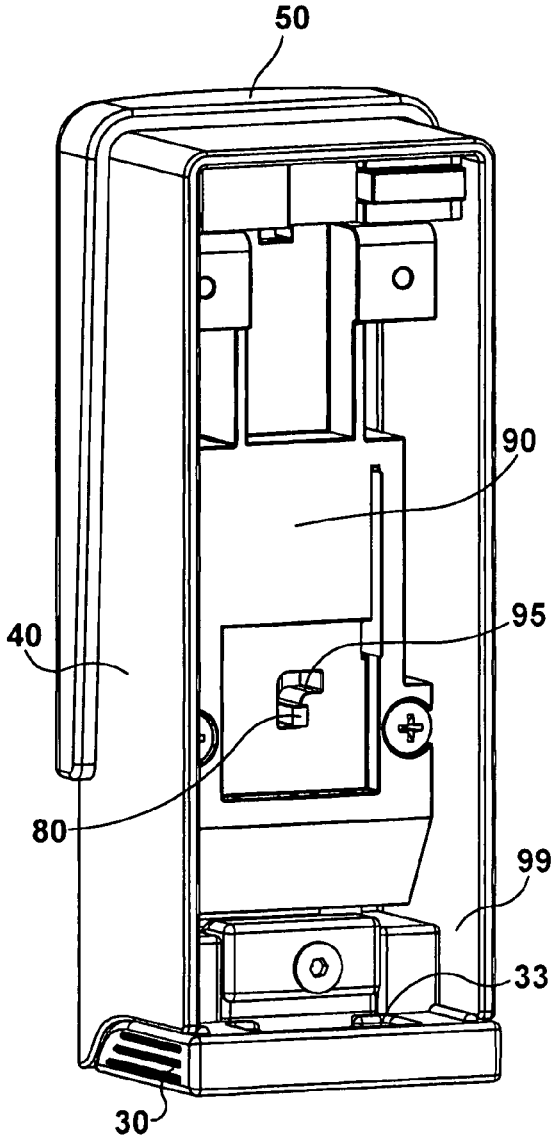
FIG. 12 illustrates a rear perspective view of the safe of FIG. 1A, shown without the retaining bracket and mounting plate.

According to another inventive aspect of the present application, a safe may include a multiple dial combination lock mechanism that can be reset or adjusted by a user to change the authorized combination for opening the safe. While many different reset configurations may be utilized, in one embodiment, a series of hubs positionable to allow movement of a release post may be disengaged or separated from corresponding user operable dials, such that the dials may be rotated or otherwise adjusted prior to re-engagement with the hubs, causing the unlocking or release position of the hubs to be associated with a different authorized dial combination. The illustrated embodiment includes a reset lever 80 (most clearly shown in FIG. 7) assembled with the post 60 below the hubs 25. The reset lever 80 extends through an opening 95 in the housing frame 90 (as shown in FIG. 12), such that a user may access the reset lever 80 when the safe 10 is removed from the structure to which it is mounted. When the dials 22 and hubs 25 are rotated to an unlocking or release position, the reset lever 80 may be lifted to a reset position to lift the hubs 25, effectively disengaging the hubs 25 from the corresponding dials 22, which are held in place by the housing slots 42. Once the hubs 25 are disengaged from the dials 22, the dials may be rotated to a desired authorized combination. When the reset lever 80 is lowered back to a standard position, which may be facilitated by a spring 85 disposed between the uppermost hub 25 and the release button 63, the hubs 25 are lowered to re-engage with the corresponding dials 22, with the nubs 27 of the hubs 25 being received in corresponding notches 23 in the dials 22. As a result, the unlocking or release position of each of the hubs 25 is then associated with a new authorized dial combination. Additionally, as shown in FIG. 12, the opening 95 in the housing frame 90 may be shaped such that the lifted reset lever 80 may be rotated and held in the reset position, such that the user may adjust the dials 22 without having to hold the reset lever 80 in the reset position.

According to still another inventive aspect of the present application, a safe may include a mounting arrangement configured to prevent removal of the safe from the structure to which it is mounted until the safe is unlocked or opened. While many different configurations may provide for this secure mounting feature, in one embodiment, a retaining bracket may be attached to the safe, and a corresponding mounting plate, configured to receive the retaining bracket, may be affixed to the structure to which the safe is to be mounted. The retaining bracket may include a button, detent, or other such protrusion that snaps into engagement with a corresponding opening, notch, or other such recess in the mounting plate, such that the detent must be depressed to disengage the retaining bracket from the mounting plate and remove the safe from the structure.

In the exemplary embodiment, a retaining bracket 100 is affixed to an upper portion of the housing frame 90, for example, by screws 101. A lower end 103 of the retaining bracket 100 is receivable through a slot 113 in a mounting bracket 110, which may be affixed to a structure, for example, using screws 111 or other fasteners (see FIG. 2). The inserted portion of the retaining bracket 100 may be biased against the mounting plate 110 such that a raised detent or protrusion 105 on the retaining bracket engages a corresponding recess 115 (which may be a hole, notch, or cut-out, or a blind hole or cavity) to secure the retaining bracket 100 and the rest of the safe 10 to the mounting plate 110. To withdraw the retaining bracket 100 from the mounting plate 110, the protrusion 105 is depressed to disengage the protrusion 105 from the recess 115. In this exemplary embodiment, to access the protrusion 105, the safe 10 must be unlocked and the door 30 must be removed, thereby exposing the protrusion 105 for user manipulation. Further, the end 103 of the retaining bracket 100 may be received in a slot 33 in the cartridge door 30 (see FIG. 12), thereby securing both ends of the locked safe 10 to the mounting plate 110.

According to yet another inventive aspect of the present application, a safe may be provided with an illumination mechanism that illuminates the lock interface (such as a keyhole or combination dials) to facilitate user manipulation of the lock interface in dark environments. In one embodiment, the illuminating mechanism is activated only when a user intends to unlock the safe (which may conserve power), for example, when a cover is removed or moved away from the combination dials. As an example, when a cover is lifted from a lock interface, a spring loaded member may be permitted to move, thereby operating a switch to power a light source directed at the lock interface, such as, for example, a light emitting diode (LED).

Figure 1B:
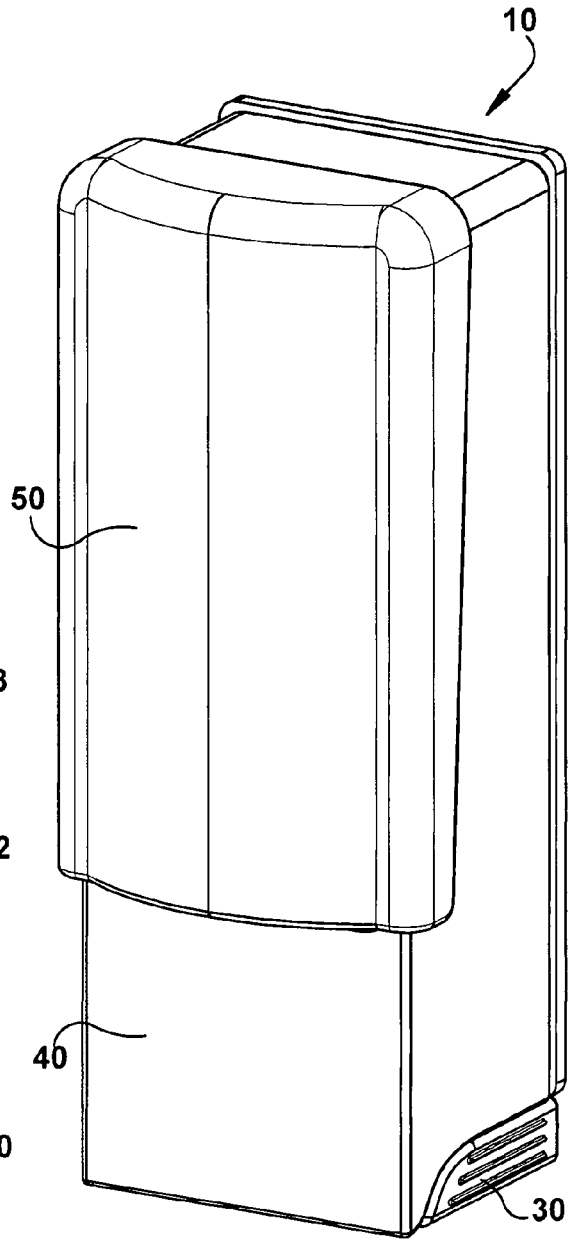
FIG. 1B illustrates a front perspective view of the safe of FIG. 1A with combination dials covered.
Figure 13:
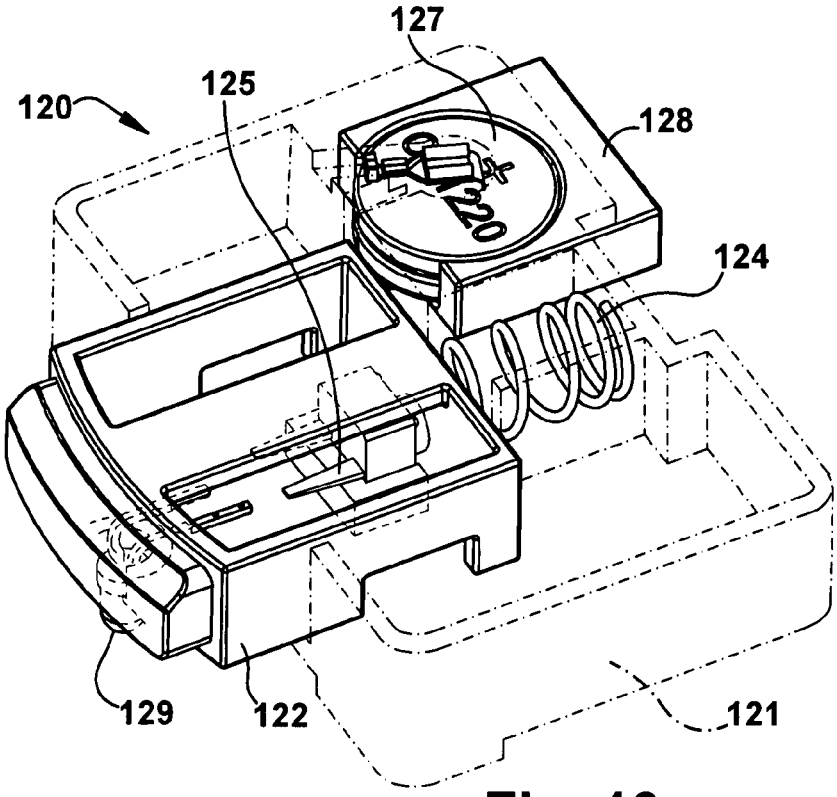
FIG. 13 illustrates a side perspective view of an illumination subassembly of the safe of FIG. 1A, with the subassembly housing shown in phantom to illustrate additional features of the subassembly.
Figure 13A:
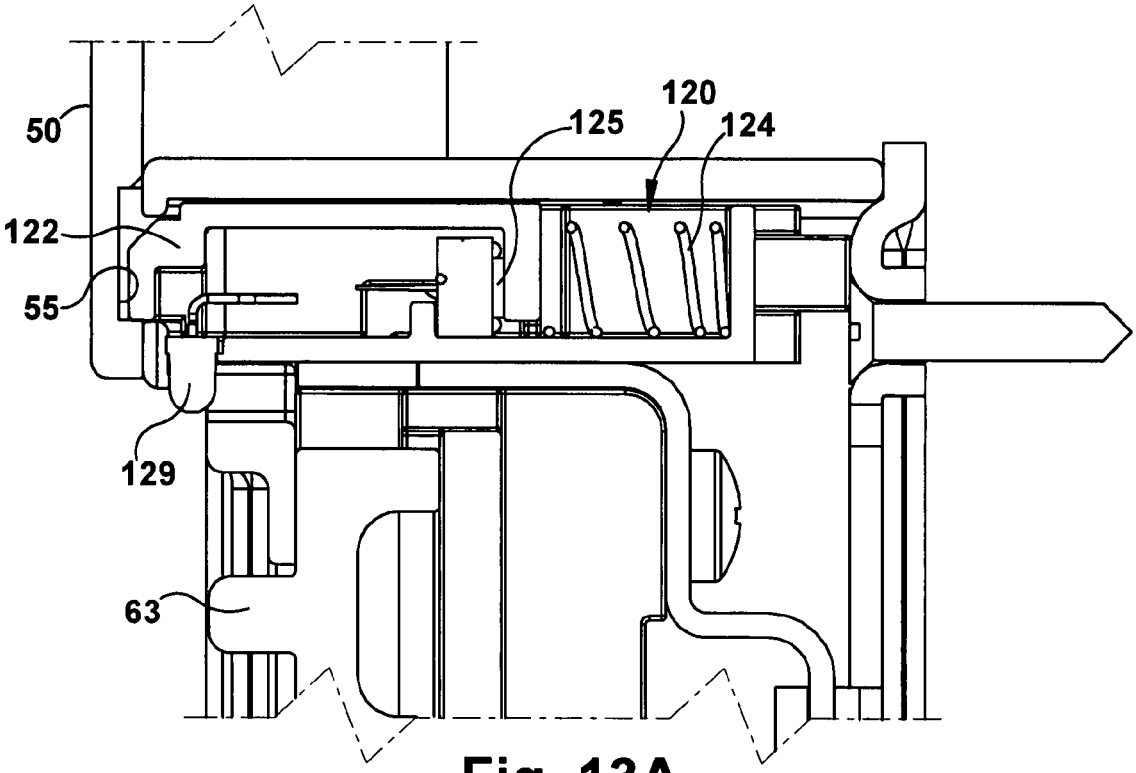
FIG. 13A illustrates a partial side cross-sectional view of the safe of FIG. 1A.
Figure 14:
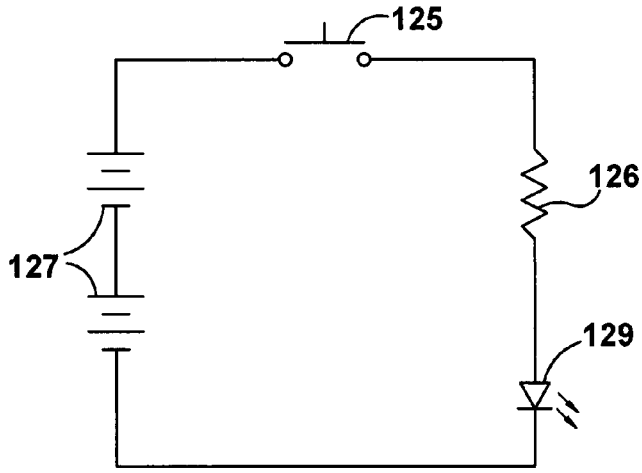
FIG. 14 is an exemplary wiring diagram for the illumination subassembly of FIG. 13.

In the illustrated example, the safe 10 includes an illumination subassembly 120 within the housing 40 above the dials 22. The illumination subassembly 120 includes a housing 121 (see FIG. 13), a button 122 slidable with respect to the housing 121, and a spring 124 positioned between the button 122 and the housing 121 to bias the button 122 away from the housing 121. Attached to the housing 121 is a LED light source 129 and batteries 127 (held in battery retainer 128) in electrical communication with a switch 125 (wiring not shown, see FIG. 14 for wiring schematic) and a resistor 126 (see FIG. 14). An end of the button 122 extends through an opening 45 in the housing 40. When the dial cover 50 is in a closed or covering position (as shown in FIG. 1B), the dial cover 50 holds the button 122 inward against the biasing force of the spring 124. When the dial cover 50 is lifted to an uncovered position to expose the dials 22, the dial cover 50 allows the button 122 to extend further through the opening 45 such that a portion of the button 122 engages the switch 125 to supply power from the batteries 127 to the light source 129. In other embodiments (not shown), the dial cover 50 may allow movement of the button 122 by separating from the button or by uncovering the button 122. In the illustrated embodiment, as shown in FIG. 13A, the dial cover 50 includes a recess 55 that aligns with the button 122 when the dial cover 50 is in an uncovered position, thereby allowing the button 122 to extend into the recess 55 and engage the switch 125. When the dial cover 50 is returned to the closed position, the dial cover presses the button 122 inward against the spring 124, separating the button 122 from the switch 125, which terminates power to the light source 129.

Figure 15A:
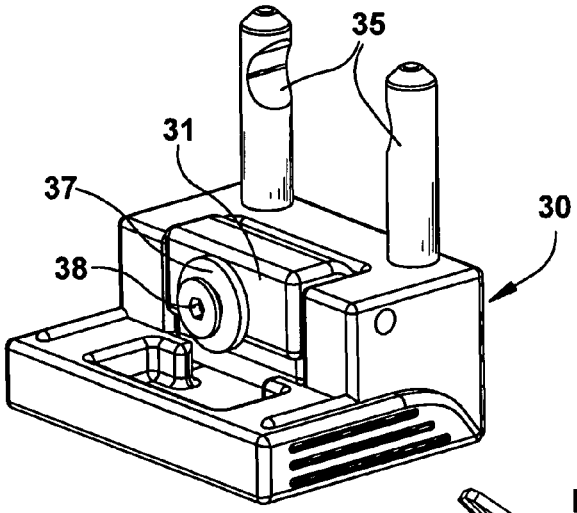
FIG. 15A illustrates a perspective view of a safe door with a retainer for securing an item.

According to another inventive aspect of the present application, a safe with a removable door may be configured to retain an item to be stored in the safe when the door is assembled with the safe housing. In one such embodiment, the safe door is configured to retain a key to be secured within the safe. In the illustrated embodiment, as shown in FIG. 15A, the door 30 includes a retainer 31 to which a key may be secured. While many different mechanisms and configurations may be used for secure retention of an item to the retainer 31, in the illustrated embodiment, a washer 37 and screw 38 assembly is used to tighten a key onto the retainer 31. This may be used, for example, to prevent loss of the key when the door 30 is removed from the safe housing 40.

Figure 15B:
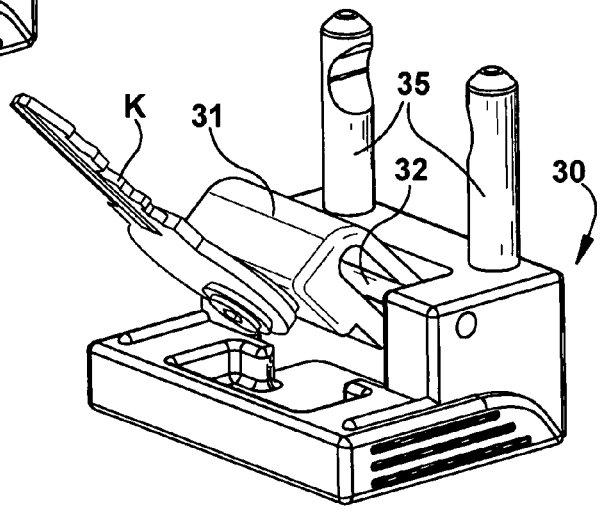
FIG. 15B illustrates a perspective view of the safe door of FIG. 15A, with a key secured to a pivotable retainer.

In some embodiments, retention of an item in an orientation conducive to storage, for example, a vertical orientation of a key with respect to the safe housing 40, may present difficulties when using the item. As one example, when a key is retained in a vertical or storage orientation on the illustrated door 30, the shackle legs 35 may interfere with use of the key in opening a corresponding lock. To facilitate use of the attached item, without having to detach the item from the door 30 and retainer 31, the retainer 31 may be configured to be pivotable with respect to the door 30. In the illustrated embodiment, the retainer 31 is pivotable about a pivot pin 32, to adjust the orientation of the key K with respect to the door 30. By pivoting the retainer 31 and key K, as shown in FIG. 15B, the key K may be used with a corresponding lock (not shown) without interference with the shackle legs 35. To store the key K in the safe 10, the retainer 31 and key K are rotated back to the storage orientation, allowing the key K to be inserted back into the cavity 99 (see FIG. 12) of the safe housing 40 when the door 30 is assembled with the housing 40.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A safe comprising:

a housing, comprising a lock interface disposed on an external surface of the housing, wherein the housing defines an internal cavity in communication with an opening in the external surface of the housing;

a door configured to be assembled with the opening of the housing, the door comprising first and second shackle legs configured to extend into the internal cavity when the door is assembled with the housing;

a locking mechanism disposed within the housing, the locking mechanism comprising at least one locking member configred to lockingly engage the first and second shackle legs when the door is assembled with the housing;

a cover member connected with the housing and movable to cover the lock interface in a covering position and to expose the lock interface in an uncovered position; and an illuminating mechanism including a light source configured to be illuminated only when the cover member is in the uncovered position;

wherein when the door is assembled with the housing, proper manipulation of the lock interface disengages the at least one locking member from the first and second shackle legs, thereby allowing the door to be removed from the housing.

2. The safe of claim 1, wherein the lock interface comprises a combination dial arrangement.

3. The safe of claim 2, wherein the combination dial arrangement comprises a plurality of combination dials.

4. The safe of claim 3, wherein each of the plurality of combination dials comprises a hub and is disposed on a post movable from a locking position to an unlocking position when each the hubs is rotated to a proper orientation, wherein the post forces the at least one locking member into engagement with the first and second shackle legs when in the locking position, and allows the at least one locking member to disengage from the first and second shackle legs when in the unlocking position.

5. The safe of claim 4, wherein the post comprises a release lever configured to disengage the combination dials from the corresponding hubs, thereby allowing each of the plurality of combination dials to be reoriented with respect to the corresponding hub, thereby changing a proper orientation of the combination dials for unlocking the safe.

6. The safe of claim 1, wherein the illuminating mechanism comprises a spring loaded member configured to operate a switch to illuminate the light source when the cover member is in the uncovered position.

7. A safe comprising:

a housing, comprising a lock interface disposed on an external surface of the housing, wherein the housing defines an internal cavity in communication with an opening in the external surface of the housing;

a door configured to be assembled with the opening of the housing, the door comprising first and second shackle legs configured to extend into the internal cavity when the door is assembled with the housing;

a locking mechanism disposed within the housing, the locking mechanism comprising at least one locking member configured to lockingly engage the first and second shackle legs when the door is assembled with the housing; and a mounting arrangement for mounting the housing to a structure, wherein access to the mounting arrangement is limited when the door is assembled with the housing to prevent disassembly of the housing from the structure;

wherein when the door is assembled with the housing, proper manipulation of the lock interface disengages the at least one locking member from the first and second shackle legs, thereby allowing the door to be removed from the housing;

further wherein the mounting arrangement comprises a mounting plate configured to be affixed to the structure, and a retaining bracket configured to engage the mounting plate, the retaining bracket having a first end portion connected with the housing and a second end portion configured to extend into the door when the door is assembled with the housing.

8. The safe of claim 7, wherein the locking mechanism further comprises a post movable from a locking position to an unlocking position upon proper manipulation of the lock interface, wherein the post forces the at least one locking member into engagement with the first and second shackle legs when in the locking position, and allows the at least one locking member to disengage from the first and second shackle legs when in the unlocking position.

9. The safe of claim 8, wherein the lock interface further comprises a user operable release member, wherein upon proper manipulation of the lock interface, the release member is operable to move the post from the locking position to the unlocking position.

10. The safe of claim 7, wherein the door comprises a retainer configured to retain an item for storage within the internal cavity when the door is assembled with the housing.

11. The safe of claim 10, wherein the retainer is pivotable with respect to the first and second shackle legs for adjustment of an orientation of the item with respect to the first and second shackle legs when the item is retained by the retainer.

12. The safe of claim 7, wherein the retaining bracket is disengageable from the mounting plate by manipulating the second end portion of the retaining bracket.

13. A safe comprising:

a housing comprising a lock interface disposed on an external surface of the housing;

a cover member connected with the housing and movable to cover the lock interface in a covering position and to expose the lock interface in an uncovered position;

a light source; and a switch configured to be automatically operated to illuminate the light source when the cover member is moved from the covering position to the uncovered position.

14. The safe of claim 13, further comprising a spring loaded member configured to operate the switch when the cover member is moved from the covering position to the uncovered position.

15. The safe of claim 14, wherein the spring loaded member comprises a button configured to be depressed by the cover member when the cover member is in the covering position, wherein release of the button operates the switch to illuminate the light source.

16. The safe of claim 13, wherein the cover member is slideable from the covering position to the uncovered position.

17. The safe of claim 13, further comprising at least one battery for supplying power to the light source.

18. The safe of claim 17, further comprising a removable retainer for retaining the at least one battery.

19. The safe of claim 13, wherein the light source comprises at least one light emitting diode.

* * * * *